US005485054A

United States Patent [19]

Van Kemenade et al.

[11] Patent Number: 5,485,054

[45] Date of Patent: Jan. 16, 1996

[54] DISPLAY TUBE HAVING A DEFLECTION COIL SUPPORT AND AN AUXILIARY DEFLECTION COIL SUPPORT

[75] Inventors: Johannus T. F. Van Kemenade; Cornelis Kortekaas, both of Eindhoven, Netherlands

[73] Assignee: U.S. Philips Corporation, New York, N.Y.

[21] Appl. No.: 128,623

[22] Filed: Sep. 28, 1993

[30] Foreign Application Priority Data

Oct. 9, 1992 [EP] European Pat. Off. ..... 92203105

[51] Int. Cl.[6] ..... H01J 29/70

[52] U.S. Cl. ..... 313/440; 313/412; 313/413

[58] Field of Search ..... 313/412, 413, 313/426, 431, 433, 440; 335/210, 211, 213, 214

[56] References Cited

U.S. PATENT DOCUMENTS

| | | | |
|---|---|---|---|
| 3,725,831 | 4/1973 | Barbin | 335/212 |
| 4,538,127 | 8/1985 | Spicer | 335/210 |
| 4,547,707 | 10/1985 | Yabase | 315/368 |
| 5,119,056 | 6/1992 | Itoh et al. | 335/213 |
| 5,166,576 | 11/1992 | Roussel | 313/431 |
| 5,179,320 | 1/1993 | Tripod | 315/399 |
| 5,223,769 | 6/1993 | Priere | 315/370 |
| 5,355,578 | 10/1994 | Van Den Berg | 29/605 |

FOREIGN PATENT DOCUMENTS

| | | | |
|---|---|---|---|
| 0381267 | 8/1990 | European Pat. Off. | H01J 9/236 |
| 0516229 | 12/1992 | European Pat. Off. | H01J 29/51 |

*Primary Examiner*—Joseph Mancuso
*Assistant Examiner*—Tuan V. Ho
*Attorney, Agent, or Firm*—Robert J. Kraus

[57] ABSTRACT

A display tube having a deflection coil support with a field deflection coil system at its outer side and a line deflection coil system at its inner side. The gun-sided end of the line deflection coil system is situated in a plane parallel to the wall of the display tube. The outer side of the coil support is surrounded by an auxiliary deflection coil system, preferably in a printed form, against the inner and for outer surface of a synthetic material supporting cylinder. This assembly, which can be used particularly for scan velocity modulation purposes, is at least partly arranged between the field deflection coil system and the wall of the display tube, while it partly overlaps the gun-sided end of the line deflection coil system.

12 Claims, 6 Drawing Sheets

DISPLAY TUBE HAVING A DEFLECTION COIL SUPPORT AND AN AUXILIARY DEFLECTION COIL SUPPORT

BACKGROUND OF THE INVENTION

The invention relates to a display tube comprising a display screen, an electron gun arranged in a neck portion opposite said screen, a deflection unit having a deflection coil support comprising a field deflection coil system at its outer side and a line deflection coil system at its inner side, and an auxiliary deflection coil system comprising at least two auxiliary deflection coils arranged around the neck portion of the display tube.

The line deflection coil system is used to deflect at the line-frequency, the electron beams generated in the display tube into a first (horizontal) direction; the field deflection coil system is used to deflect, at the field-frequency, the electron beams into a second direction, transverse to the first direction.

A system of auxiliary deflection coils may be used for several reasons.

To improve the picture quality it is known, for example to subject the electron beams to scan velocity modulation (s.v.m.) during deflection by means of an s.v.m auxiliary deflection coil system. In this modulation method, the velocity during deflection of the electron beams in the horizontal direction is influenced by means of the differentiated video signal so that luminance transitions on the display screen will be sharper. It is also known to influence the deflection of the electron beams in a vertical direction in such a way that the flickering phenomenon occurring when displaying inserted symbols (such as teletext) is suppressed. Auxiliary deflection coil systems are also used in the field of convergence correction.

In a known deflection unit the two self-supporting saddle coils of an s.v.m. auxiliary deflection coil system are slid from the wide end into the cylindrical part of a deflection coil support before the line deflection coil system is arranged on its inner surface. After the deflection unit has been arranged on a display tube, the auxiliary deflection coil system is thus present between the gun-sided end of the line deflection coil system and the location where the electron beams are generated. This construction is based on the idea that the auxiliary deflection coils should be located as close as possible to the electron beams, i.e. in connection with the sensitivity they should abut the glass of the neck of the display tube.

However, practice proves that certain display tubes comprising such a system of auxiliary deflection coils for scan velocity modulation do not come up to expectations. The invention is based on the recognition that in display tubes comprising deflection units having relatively long (line) deflection coils a position of the auxiliary deflection coil systems as described above (i.e. too close to the electron gun) is not optimal. However, a position more to the front would mean that in the known construction the svm coil system must either be shortened which is not advantageous from an energetic point of view, or must be arranged completely or partly within the line deflection coils so that unwanted electromagnetic coupling giving rise to "ringing" may occur in some cases.

SUMMARY OF THE INVENTION

It is an object of the invention to provide a construction which enables auxiliary deflection coils, particularly s.v.m. auxiliary deflection coils, to be positioned at a location which is as favourable as possible for the operation, particularly, independent of the length and position of the line deflection coils, and preferably without this construction giving rise to the occurrence of electric interferences such as ringing.

To this end a display tube of the type described in the opening paragraph is characterized in that the system of line deflection coils is of the mussel type, and the system of auxiliary deflection coils is arranged on an inner and/or outer surface of an annular synthetic material support which is arranged at the outer side around the deflection coil support. These measures enable positioning at any desired axial position without (the gun-sided end of) the line deflection coil system being an impediment.

Moreover, due to the positioning at the outer side of the deflection coil support, hence outside the risk of unwanted magnetic coupling is reduced (the line deflection coils). The idea that the auxiliary deflection coils should engage the display tube has been left in this case. The annular synthetic material support may be located completely or partly within the field deflection coil system if the latter is of the toroidal, the saddle or the mussel type, and it may surround the field deflection coil system if the latter is of the mussel type. These specific arrangements particularly provide the possibility of arranging the screen-sided ends of the auxiliary deflection coils not only closer to the display screen than the gun-sided ends of the line deflection coils, but also than those of the field deflection coils, which yields extra freedom.

A first embodiment of the invention, which is particularly suitable if the field deflection coil system extends relatively far towards the electron gun (which may be the case, particularly if the field deflection coils are saddle-type coils with the gun-sided end lying in a plane, parallel to the tube's neck: referred to as mussel-type coils is characterized in that the auxiliary deflection coil system comprises a synthetic material supporting cylinder having a first annular part fitting around the gun-sided end of the deflection coil support and within the field deflection coil system and providing a seating for the auxiliary deflection coils between its inner surface and the deflection coil support.

This embodiment provides a (protective) mounting cylinder for the auxiliary deflection coils which enables the auxiliary deflection coils to be positioned at the outer side of the deflection coil support, at least partly within the field deflection coil system. To a certain extent, the axial position of the auxiliary deflection coils may be chosen to be independent of the length and position of the field deflection coils. Conversely, it is advantageous for the designer of the coils that the lengths of the line and/or field deflection coils can be modified, if necessary, without taking the presence of the auxiliary deflection coils into account.

The auxiliary deflection coils may be implemented in different manners. For example, they may be wound of copper wire or provided as a pattern of electrically conducting "ink" on the inner surface of the synthetic material cylinder. Also in connection with the available small space, it is very practical to use "spiral" coils provided on a synthetic foil. The synthetic foil may be wound once or several times around the cylindrical end of the deflection coil support and may be provided with auxiliary deflection coils at one or both sides by means of printing or by vapour deposition.

An advantage of the use of auxiliary deflection coils provided at one side of a synthetic material foil is, for example that a grounded electrically conducting pattern functioning as an electric shielding can be provided on the other side of the foil. This may prevent, for example the high-frequency svm signal from being coupled into the video amplifiers.

These and other aspects of the invention will be apparent from and elucidated with reference to the embodiments described hereinafter.

BRIEF DESCRIPTION OF THE DRAWING

In the drawings:

FIG. 1*a* is a diagrammatic configuration of an auxiliary deflection coil system;

DESCRIPTION OF THE PREFERRED EMBODIMENTS

Figure 1:
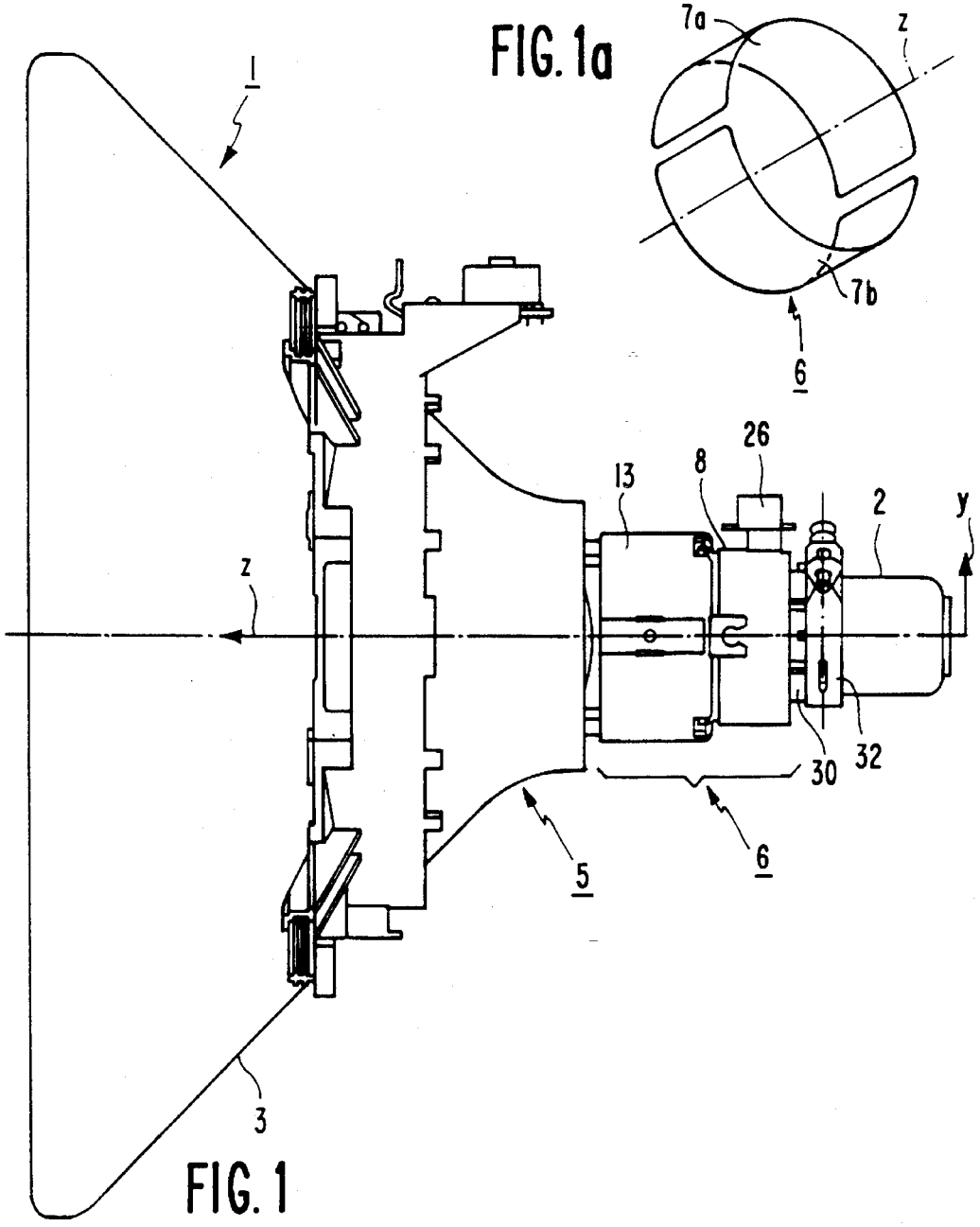
FIG. 1 is a diagrammatic elevational view of a display tube comprising a deflection unit and an auxiliary deflection coil system according to the invention.

The colour display tube 1 shown diagrammatically in FIG. 1 comprises a cylindrical neck portion 2 accommodating an electron gun system (not shown in FIG. 1) for generating three approximately coplanar electron beams, and a funnel-shaped portion 3. A deflection unit 5 which is combined with an auxiliary deflection coil system 6 is present at the area of the interface between the two portions. As is shown in FIG. 1*a*, this system 6 may comprise a plurality of coils 7*a*, 7*b* formed as spirals and directed radially towards the axis z of the tube neck 1, which coils are arranged in a holder 8 in such a way that their axes are coplanar. The coils 7*a*, 7*b* may be energized, for example by means of a derived video signal so as to subject the electron beams generated by the electron gun system to a scan velocity modulation during deflection by the deflection unit 5.

Figure 2:
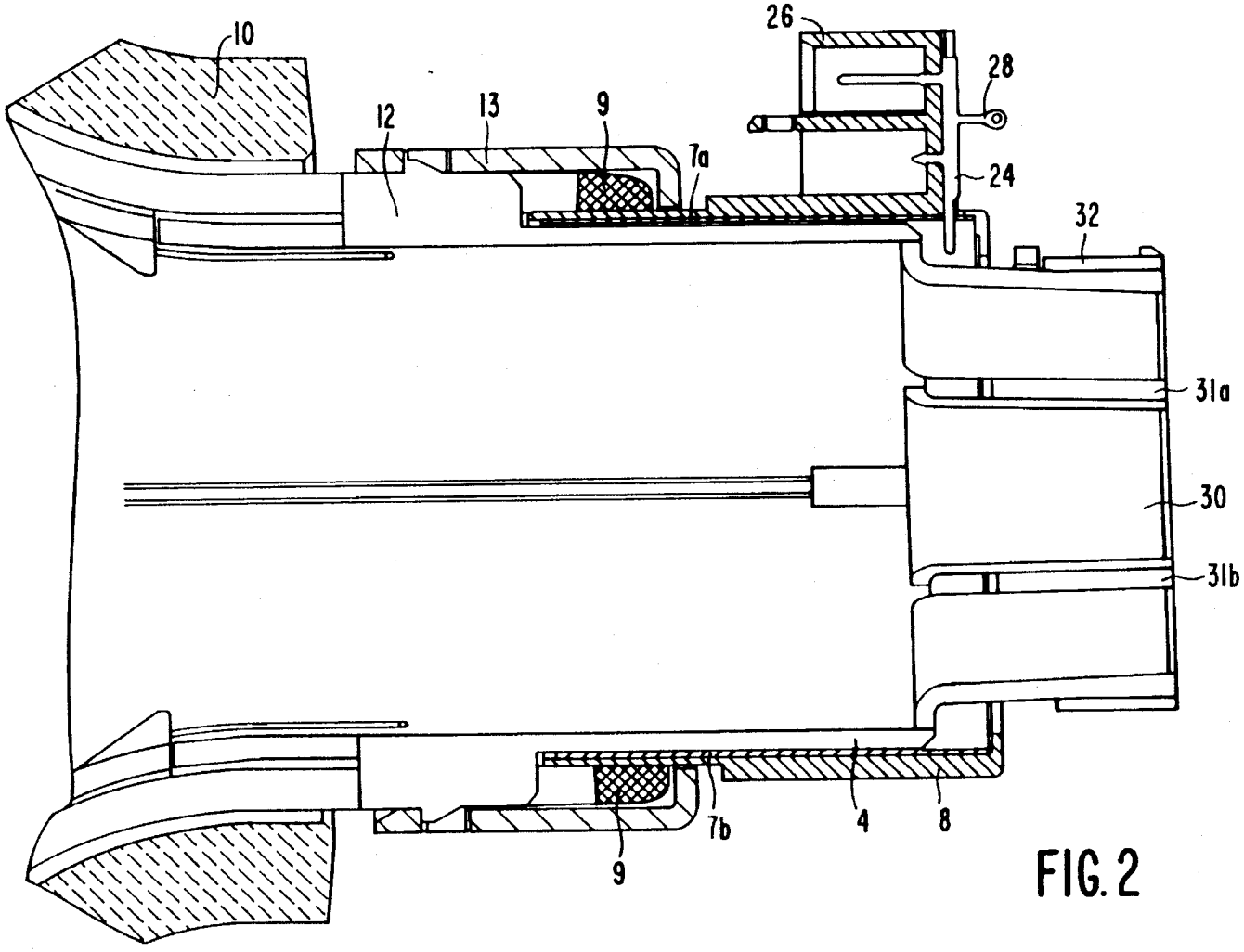
FIG. 2 is a cross-section of a part of a deflection unit on which an auxiliary deflection coil system according to the invention is arranged.

A part of the deflection unit 5 is shown in greater detail in a cross-section in FIG. 2. The deflection unit has a yoke ring 10 and, inter alia a deflection coil support 4 which supports a field deflection coil system 9, 9' (only one part, viz. the gun-sided end of saddle-type field deflection coil 9 with the gun-sided end turned down is visible in the Figure). An auxiliary deflection coil support 8 supporting the auxiliary deflection coil system 7*a*, 7*b* at its inner side is arranged partly between the field deflection coil system 9, 9' and the support 4.

Figure 3:
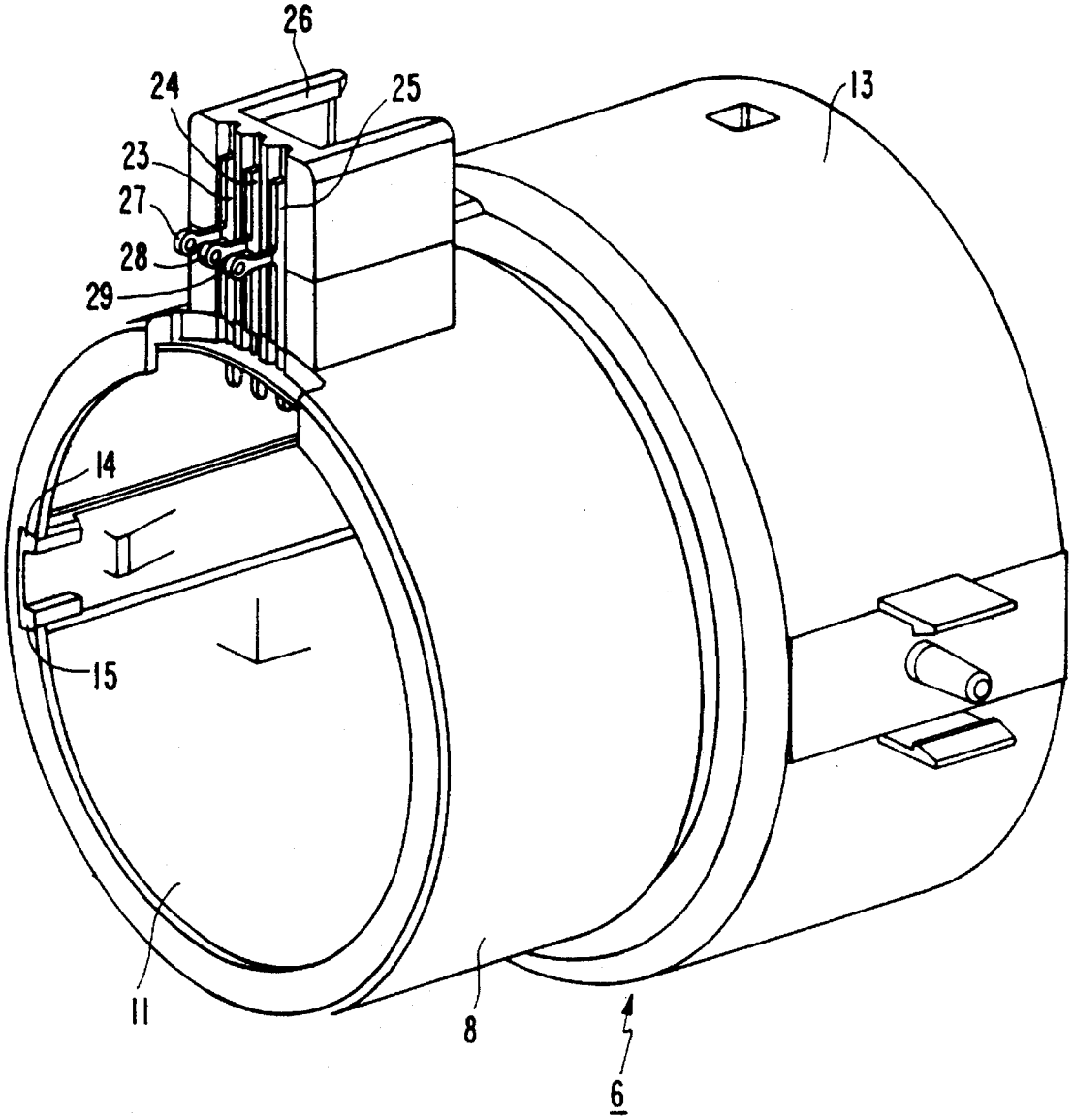
FIG. 3 is a perspective elevational view of a mounting cylinder for the auxiliary deflection coil system of FIG. 2.
Figure 4:
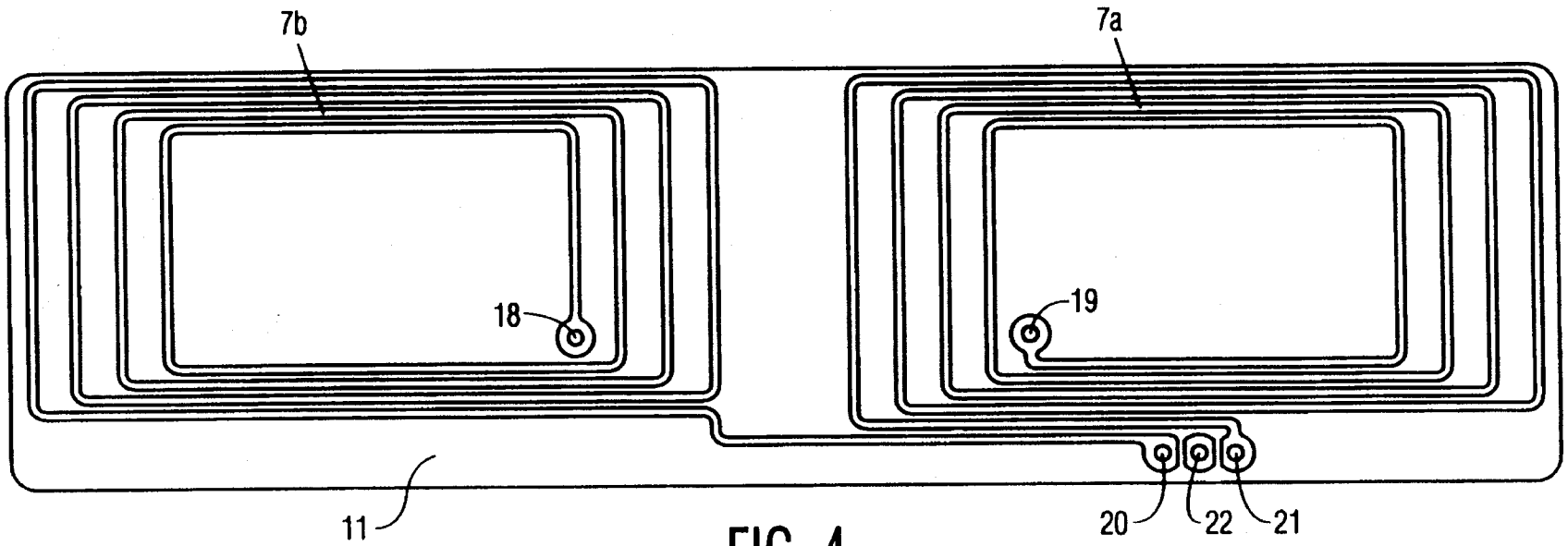
FIG. 4 shows the layout of an svm print coil pattern.

The auxiliary deflection coils 7*a*, 7*b* may be arranged in, for example, a vapour deposited or printed (spiral) form on an elongate, electrically insulating strip 11 (of for example synthetic material) (FIG. 4). This strip is rolled up, so that the coils 7*a*, 7*b* acquire a configuration as is shown in FIG. 1*a*, and is enclosed in an annular synthetic material supporting cylinder 8 which in its turn is slid on the gun-sided end of the deflection coil support 4 until the desired position is reached. To enable the supporting cylinder to be slid under the gun-sided end of field deflection coil 9, the outer diameter of support 4 at the gun side is preferably reduced. The supporting cylinder may be provided with an annular part 13, or securing ring, which fits around the gun-sided end of the field deflection coil 9 and the support 4 may be provided with means 12 (for example, a ring or a shoulder) which cooperate with a part 13 so as to secure the synthetic material supporting cylinder 8 (detachably) to the support 4. This is illustrated in FIG. 3 which is a perspective elevational view of the supporting cylinder 8 with the securing ring 13. FIG. 3 also shows the strip 11 of synthetic material foil which is enclosed in the supporting cylinder 8. The auxiliary deflection coils are not shown in this Figure.

Projections 14, 15 ensure a correct positioning of the strip 11.

Figure 5:
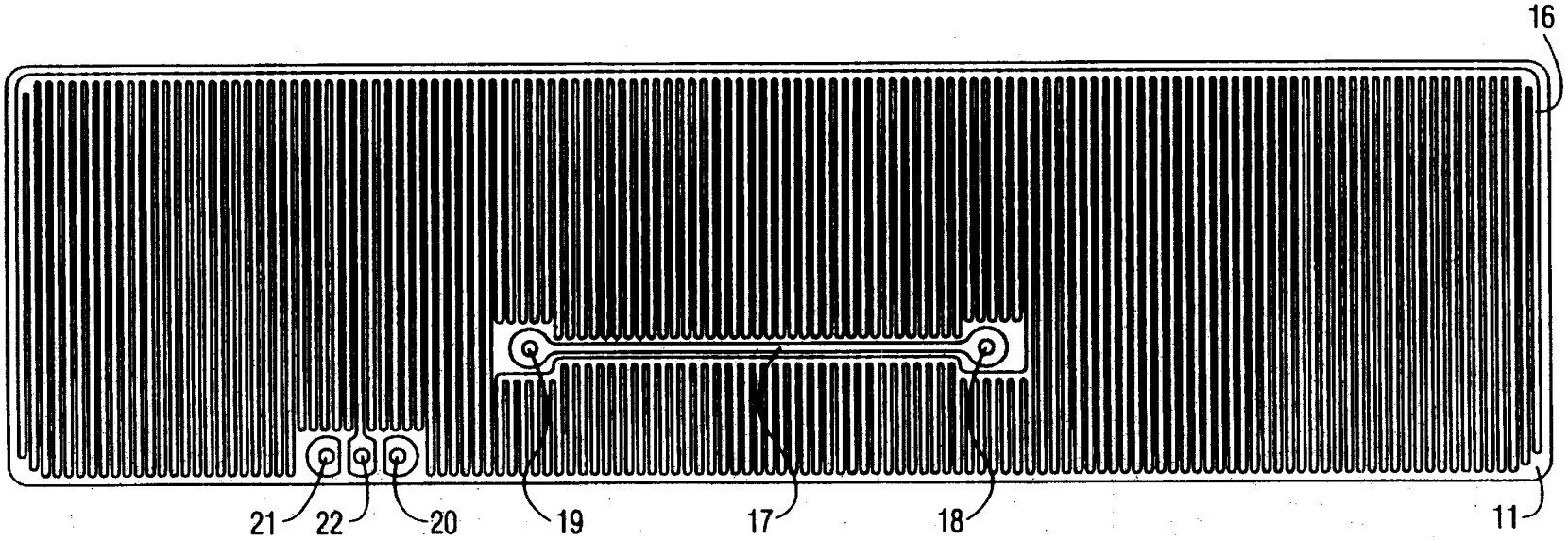
FIG. 5 shows the layout of a shielding pattern to be combined with the layout of FIG. 4.

FIG. 5 shows the rear side of the strip 11. This strip is provided with a conductor pattern 16, in this case a meandering pattern which is used as a shielding. A strip 17 interconnecting coil 7*a* to coil 7*b* via metallized apertures 18, 19 is also provided. The coils 7*a*, 7*b*, and the pattern 16 may be connected via respective metallized apertures 20, 21 and 22. A very practical connection is realised by using three contact pins 23, 24, 25 (FIG. 3) which project through the wall of the supporting cylinder and make contact with metallized apertures 20, 21, 22. The contact pins 23, 24, 25 are placed in grooves in the wall of a synthetic material housing 26 which may be moulded onto the supporting cylinder and may have contact pins 27, 28, 29 for further connection. FIG. 2 shows a clamping piece 30 provided with grooves 31*a*, 31*b* . . . etc. which, in cooperation with a clamping ring 32, ensures that the support 4 is secured to the neck of a display tube. In the configuration shown in FIG. 4 the two auxiliary deflection coils 7*a*, 7*b* (intended for scan velocity modulation) each have more than two (in this case four) spiral turns so as to improve the sensitivity, while the spiral turn portions extending at both sides in the direction of the axis of the deflection unit are located at 15°, 25°, 35° and 45°, respectively, with respect to the axis (average angle position 30°). An alternative coil construction has three spiral turns with the axial portions at 10°, 30° and 50° (average angle position is also 30°). However, the invention is not limited to these specific auxiliary deflection coil configurations. In another embodiment the auxiliary deflection coils may be, for example a system of convergence correction coils, for example one set of convergence correction coils for x correction (correction in the horizontal direction) and/or one set of correction coils for y correction (correction in the vertical direction).

Figure 6A:
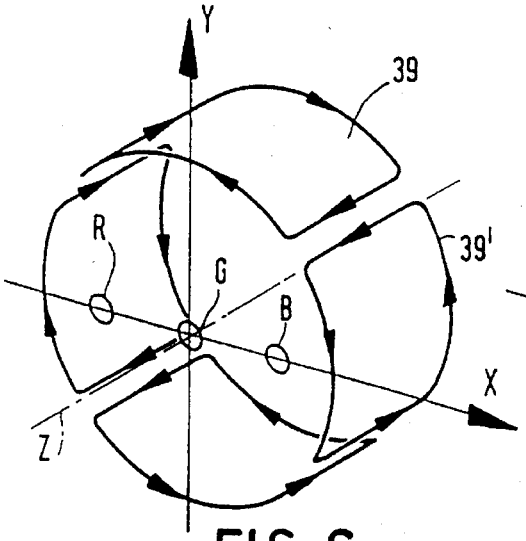
FIGS. 6*a*, 6*b* and 7 are diagrammatic configurations of the auxiliary deflection coil system for convergence correction
Figure 6B:
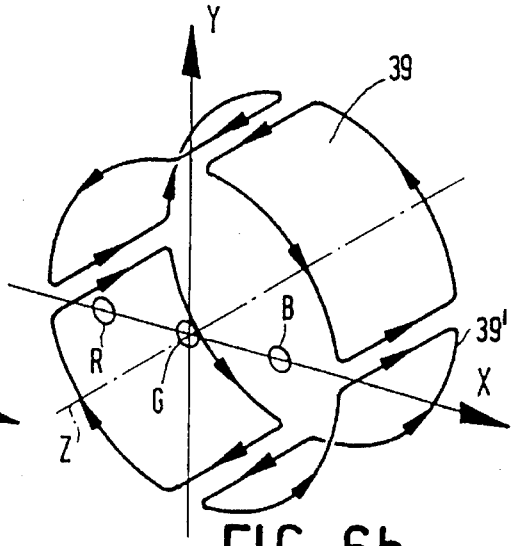

As is shown in FIGS. 6*a* and 6*b*, a convergence correction coil system may comprise a plurality of coils 39, 39' . . . formed as flat spirals directed radially towards the axis z of the tube neck 1, which coils are arrange in such a way in a holder secured to the deflection unit that their axes are coplanar. If the coils 39, 39', . . . are connected to one or more current sources, magnetic fields resulting in a displacement of the three electron beams R, G, B are generated within the tube neck 2. Positioned and energized with four coils 39, 39' . . . , as in the embodiment of FIG. 6*a*, red-blue y errors (y astigmatism errors) can be corrected. A four-pole field having a horizontal axial direction causes a vertical displacement of the outer beams R, B in opposite directions, and a four-pole field having an axial direction at 45 degrees to the horizontal causes a similar displacement in the horizontal direction (FIG. 6*b*).

Red-blue-green x errors (x coma errors) or red-blue-green y errors (y coma errors) can be corrected by means of six coils positioned and energized in the correct way.

A magnetic six-pole field having an axis in the plane of the three beams R, G, B, i.e. horizontal, causes a similar displacement of the two outer beams R, B in a direction perpendicular to the plane of the beams, while the intermediate beam G is not influenced, as is known, for example, from U.S. Pat. No. 3,725,831. A six-pole field, an axis of which is perpendicular to the plane of the three beams (i.e. vertical), thus causes a simultaneous displacement of the outer beams R, B to the left or to the right.

Figure 7:
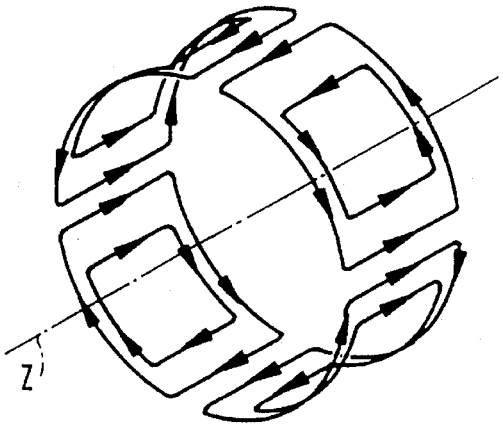

The embodiment in FIG. 7 shows a coil configuration comprising four coils having a greater sensitivity. This is the result of the fact that the coils in question have a special winding distribution in which the axial winding sections are located at a predetermined (angular) distance.

If the electrical sensitivity is an important aspect, the embodiment described with reference to FIGS. 2 and 3 will be very suitable.

Figure 8:
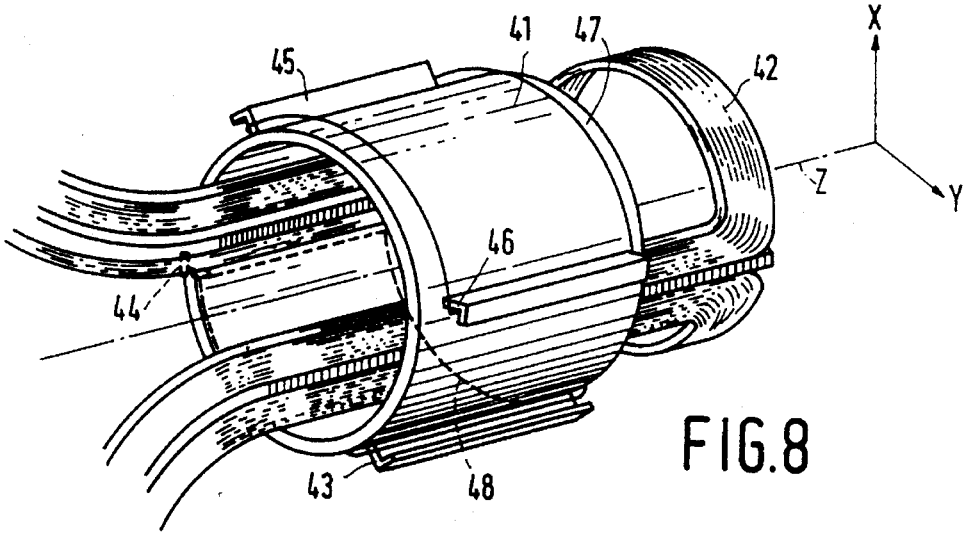
FIG. 8 shows a mounting cylinder arranged around the end of the field deflection coil, with auxiliary deflection coils as an alternative to the construction shown in FIG. 3.

An embodiment which is less optimal as far as electrical sensitivity is concerned, is shown in FIG. 8. In this case an annular synthetic material supporting cylinder 41 is slid at the outer side on the gun-sided end of a field deflection coil 42. In this case the outer side of the supporting cylinder 41 has a plurality of axially extending hook-shaped wire fixation means 43, 44, 45 and 46. Two auxiliary deflection coils 47 and 48 of the saddle type are wound around these means 43, 44, 45 and 46, which coils are thus arranged diametrically opposite each other with respect to the z axis. (It is to be noted that, as compared with the situation shown in FIGS. 1 and 2, the coils 47 and 48 are rotated with respect to the field deflection coil 42 in this case.) The embodiment of FIG. 8 also provides the possibility of positioning the auxiliary deflection coils independently of the position and length of the (field and) line deflection coils.

We claim:

1. A display tube having a longitudinal axis and comprising a display screen, an electron gun disposed in a neck portion of the tube for producing at least one electron beam, and electron beam deflection means arranged on the tube for deflecting the at least one electron beam, said electron beam deflection means including:

a. a first deflection coil support having an inner surface and an outer surface;

b. a line deflection coil system of the mussel type disposed adjacent the inner surface of the first deflection coil support;

c. a field deflection coil system disposed adjacent the outer surface of the first deflection coil support;

d. a second deflection coil support having a coil support surface which is disposed around a portion of the first deflection coil support that is located adjacent the neck portion of the tube; and e. an auxiliary deflection coil system, comprising first and second auxiliary deflection coils, disposed adjacent said coil support surface of the second deflection coil support.

2. A display tube as in claim 1 where the coil support surface of the second deflection coil support includes a portion which extends along an axially extending portion of the field deflection coil system.

3. A display tube as in claim 2 where said portion of the coil support surface extends within said axially extending portion of the field deflection coil system.

4. A display tube as in claim 3 where the second deflection coil support comprises a synthetic material cylinder having a first annular part disposed around a gun sided end of the first deflection coil support and within the axially extending portion of the field deflection coil system, at least a portion of the auxiliary deflection coil system being disposed between said first annular part and said gun sided end of the first deflection coil system.

5. A display tube as in claim 4 including means for detachably securing the second deflection coil support to the first deflection coil support.

6. A display tube as in claim 1 or 2 where a screen sided end of the auxiliary deflection coil system is closer to the display screen than a gun sided end of at least one of the line deflection coil system and the field deflection coil system.

7. A display tube as in claim 1 or 2 where the auxiliary deflection coil system comprises first and second spiral coils formed by a pattern of electrically conducting material disposed on a first surface of a synthetic material foil.

8. A display tube as in claim 7 where the synthetic material foil includes a conductive electric shield disposed on a second surface of said foil which is opposite the first surface.

9. A display tube as in claim 8 where the pattern of electrically conducting material includes a pattern of connection contacts and where the second deflection coil support includes electrical connection means in contact with said connection contacts.

10. A display tube as in claim 7 where the pattern of electrically conducting material includes a pattern of connection contacts and where the second deflection coil support includes electrical connection means in contact with said connection contacts.

11. A display tube as in claim 10 where the electrical connection means comprise conductive pins which extend through apertures in the connection contacts.

12. A display tube as in claim 7 where each of the spiral coils includes first and second groups of axially extending segments, each of said groups being confined within a respective thirty degree arc, measured around the axis.

* * * * *